US005870009A

United States Patent [19]

Serpinet et al.

[11] Patent Number: 5,870,009

[45] Date of Patent: Feb. 9, 1999

[54] ADJUSTABLE ELECTROMAGNETIC TRIP DEVICE AND A CIRCUIT BREAKER COMPRISING SUCH A TRIP DEVICE

[75] Inventors: Marc Serpinet, Le Floreal; Laurent Previeux, Grenoble, both of France

[73] Assignee: Schneider Electronic SA, France

[21] Appl. No.: 955,707

[22] Filed: Oct. 23, 1997

[30] Foreign Application Priority Data

Nov. 7, 1996 [FR] France ..... 96 13834

[51] Int. Cl.[6] ..... H01H 9/00

[52] U.S. Cl. ..... 335/176; 335/45; 335/174

[58] Field of Search ..... 335/176, 45, 197, 335/174, 38; 200/231

[56] References Cited

FOREIGN PATENT DOCUMENTS 0369899 5/1990 European Pat. Off. .

1072669 9/1954 France .

403877 10/1924 Germany .

322095 11/1929 United Kingdom .

*Primary Examiner*—Lincoln Donovan

*Assistant Examiner*—Richard K. Lee

*Attorney, Agent, or Firm*—Parkhurst & Wendel

[57] ABSTRACT

The trip device comprises a magnetic circuit having a first and second fixed parts, a movable element and an adjustment device. The adjustment device comprises a shunt and an air gap arranged between the first and second fixed parts branched off with respect to the mobile element. The tripping threshold of the trip device is modified by varying the air gap distance between the shunt and the second fixed part. In a circuit breaker, the mobile element acts on an opening mechanism and an adjustment part acts on the adjustment device making the air gap distance vary. A sensor associated to the magnetic circuit supplies a measurement signal to a processing unit.

8 Claims, 2 Drawing Sheets

ADJUSTABLE ELECTROMAGNETIC TRIP DEVICE AND A CIRCUIT BREAKER COMPRISING SUCH A TRIP DEVICE

FIELD OF THE INVENTION

1. Background of the Invention

The invention relates to an adjustable electromagnetic trip device comprising:

- a fixed magnetic circuit designed to be associated to an electrical conductor,
- a movable magnetic element maintained at a predefined maximum air gap distance with respect to the magnetic circuit,
- adjustment means to vary a current threshold of the conductor for which the movable element moves from a first open operating position to a second closed tripped position.

2. Description of the Prior Art

Prior art electromagnetic trip devices comprise manner a fixed magnetic circuit and a movable magnetic element arranged at a predefined air gap distance with respect to said fixed magnetic circuit. The magnetic circuit and the movable element are associated with an electrical conductor of a power system to be protected through which a current flows. The electrical current flowing in the conductor generates a magnetic flux in the magnetic circuit and in the movable element. If the current exceeds a preset value, a magnetic field attracts the movable element towards the magnetic circuit. The preset current value depends on the initial air gap distance between the movable element and the magnetic circuit and on the tension of the return spring.

In a circuit breaker, the trip device actuates the opening of contacts when the movable element is attracted. To adjust the threshold of the preset current value, circuit breakers comprise setting means connected to a setting device of the trip device.

Prior art adjustment devices act either on the air gap distance between the movable element and the magnetic circuit, or on the force of a return spring of the movable element.

However, these adjustment devices are not very precise and do not enable an appreciably linear setting to be achieved over a wide tripping threshold range.

Moreover, these devices can not have shapes easily adaptable to different circuit breaker ratings, nor can they be easily associated to sensors for other protection functions.

SUMMARY OF THE INVENTION

The object of the invention is to achieve an electromagnetic trip device comprising a precise adjustment device able to be easily adaptable.

In a trip device according to the invention, the adjustment means comprise a magnetic shunt with an air gap arranged between a first and second fixed parts, adjustment of the current threshold making the air gap distance of said magnetic shunt vary.

Preferably, the magnetic shunt is arranged as a branch-off, between the first and second fixed parts, with respect to the movable element.

According to a particular embodiment, the movable magnetic element is a blade positioned facing the fixed parts of the magnetic circuit.

According to a preferred embodiment, the movable magnetic element is a plunger sliding with respect to the first fixed part of the magnetic circuit, said plunger having an air gap of a large distance with respect to the second fixed part of the magnetic circuit when it is in a first open position and a small or nil air gap with respect to said second fixed part when it is in a second closed position.

For strong currents of the electrical conductor, the magnetic circuit comprises staggered air gaps.

A circuit breaker according to the invention comprises main contacts, an opening mechanism associated to the main contacts, adjustment parts, and at least one trip device associated to at least one main conductor, the adjustment parts being connected to the adjustment means of said trip device, and the movable magnetic element being connected to the opening mechanism.

In a preferred embodiment, a circuit breaker according to the invention comprises a processing unit, a trip relay connected to the opening mechanism, at least one sensor connected to the processing unit supplying a value representative of a current in the main circuit and second adjustment means connected to the processing unit.

Preferably, the sensor is a sensor sensitive to a magnetic quantity arranged in an air gap of the magnetic circuit.

BRIEF DESCRIPTION OF THE DRAWINGS

Other advantages and features will become more clearly apparent from the following description of particular embodiments of the invention given as non-restrictive examples only and represented in the accompanying drawings in which.

DETAILED DESCRIPTION OF THE PREFERRED EMBODIMENT

Figure 1:
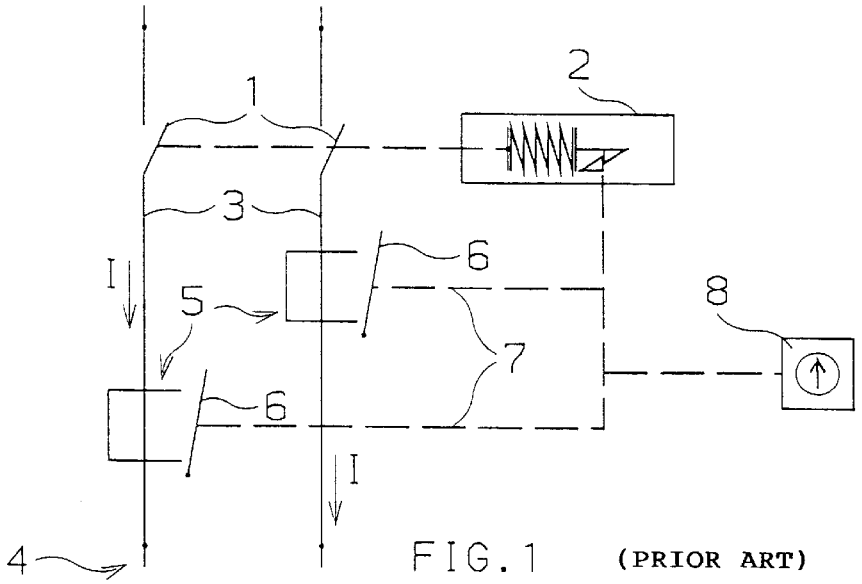
FIG. 1 (PRIOR ART)
FIG. 1 represents the diagram of a circuit breaker of known type.

The circuit breaker of known type represented in the diagram of FIG. 1 comprises contacts 1 operated by an opening and closing mechanism 2. The contacts 1, connected to conductors 3 supplying a power system 4 to be protected, are notably used to interrupt a current I in said conductors when an electrical fault occurs.

In the circuit breaker of FIG. 1, electrical faults due to short-circuits are detected by electromagnetic trip devices 5 associated to the conductors 3. The trip devices 5 have a movable element 6 connected by a mechanical link 7 to the opening mechanism 2. The circuit breaker comprises an adjustment device 8 to adjust the tripping threshold for a preset current value IS. The adjustment device can act directly on the trip device or on the mechanical link 7.

If a current I of the circuit breaker exceeds the threshold value IS, the movable element of the trip device involved is activated and the mechanical link 7 acts on the opening mechanism 2 to cause opening of the contacts 1.

Figure 2:
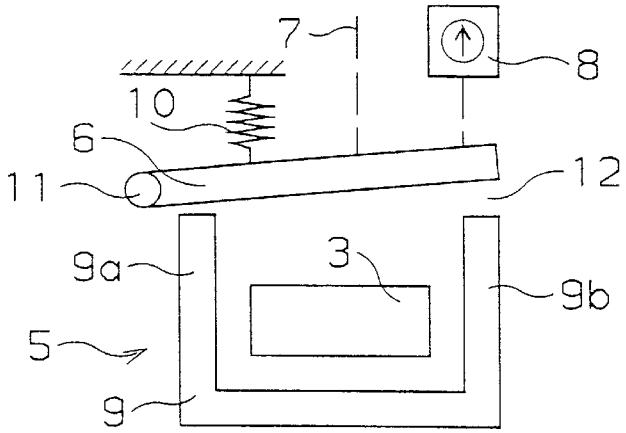
FIG. 2 (PRIOR ART)
FIG. 2 represents the diagram of an electromagnetic trip device of known type.

FIG. 2 shows an electromagnetic trip device 5 comprising a fixed magnetic circuit 9 and a movable element 6 kept in an open position by a return spring 10. The magnetic circuit 9 has a first and a second fixed parts respectively 9*a* and 9*b*.

The movable element 6 is in the form of a blade articulated around a spindle 11. An air gap 12 is situated between the second fixed part 9*b* of the magnetic circuit and the movable element 6. The distance of the air gap 12 is maximum when the blade 6 is in the open position. The adjustment device 8 bears on the blade 6 to adjust the maximum distance of the air gap and determine the tripping threshold. However, this adjustment mode is not very precise over a wide operating range.

Figure 3:
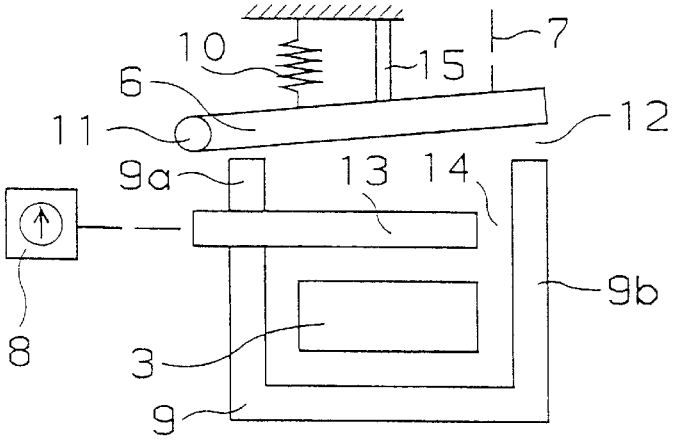
FIG. 3 the diagram of an electromagnetic trip device according to a first embodiment of the invention.

A trip device according to a first embodiment of the invention, represented in FIG. 3, enables a more precise threshold adjustment to be achieved. The trip device comprises an adjustment device with a shunt and variable air gap. The shunt is arranged branched off with respect to the movable element between the first and second fixed parts 9*a* and 9*b*.

In the trip device of FIG. 3, a shunt 13 slides in contact with the first fixed part 9*a* and forms an adjustable air gap 14 with respect to the second fixed part 9*b*. The adjustment device 8 acts on the shunt 13 to make the air gap 14 vary.

If the air gap 14 has a large distance, the magnetic flux generated by the current of the conductor 3 flows through the magnetic circuit and mainly through the movable element via the air gap 12. A small part of the flux being diverted by the shunt 13 and air gap 14, the current threshold IS is minimum. The threshold depends on the distance of the air gap 12.

Said maximum distance in the open position of the movable element is limited by a stop 15 and the return spring 10.

When the adjustment device 8 positions the shunt 13 at a small air gap distance 14, a large part of the magnetic flux generated in the fixed circuit 9 is diverted by said shunt. The magnetic flux flowing through the movable element is reduced. This reduction of the proportion of magnetic flux flowing through the movable element 6 with respect to the flux of the magnetic circuit 9 or of the shunt 13 has the effect of raising the tripping threshold of the trip device.

As the movable element is attracted towards the magnetic circuit for a preset magnetic field value of the air gap 12, the value of the tripping threshold current IS must be higher if the air gap diverts a larger proportion of magnetic flux.

Such an adjustment which does not have a direct mechanical effect on the movable element enables a great precision of tripping to be achieved over a wide range of adjustment.

Figure 4:
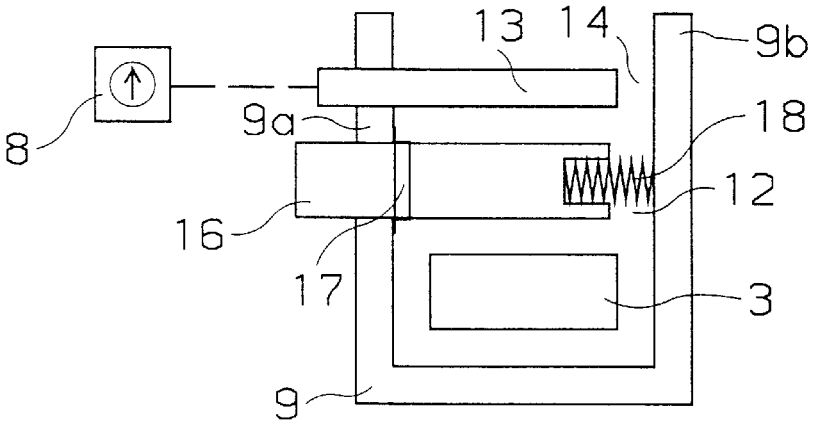
FIG. 4 represents the diagram of an electromagnetic trip device according to a second embodiment of the invention.

FIG. 4 shows a trip device according to a preferred embodiment of the invention. In this case, the movable element is a sliding plunger 16. The plunger 16 slides with respect to the first fixed part 9*a* of the magnetic circuit and forms an air gap 12 with respect to the second fixed part 9*b*. A stop 17 keeps the plunger in an open position at a preset maximum air gap distance 12 when a spring 18 repels said plunger towards the first fixed part 9*a*.

The magnetic flux generated in the magnetic circuit is staggered between the sliding core 16 and the shunt 13 arranged in parallel. If the air gap 14 decreases following an action on the adjustment part, the tripping threshold increases as a smaller proportion of the magnetic flux flows via the plunger 16.

This adjustment mode consisting in varying the tripping threshold by modifying the proportion of diverted magnetic flux with respect to the movable element enables a great ease of adjustment even for very large current threshold variations. This arrangement also enables the operating rating to be easily changed. For example, for strong currents, the fixed magnetic circuit can comprise one or more distributed air gaps to decrease the flux. Thus, the movable element and its air gap, the shunt and its air gap and the adjustment part can remain identical according to the rating of the trip device. Only the fixed part of the magnetic circuit can comprise air gaps to change rating.

Figure 5:
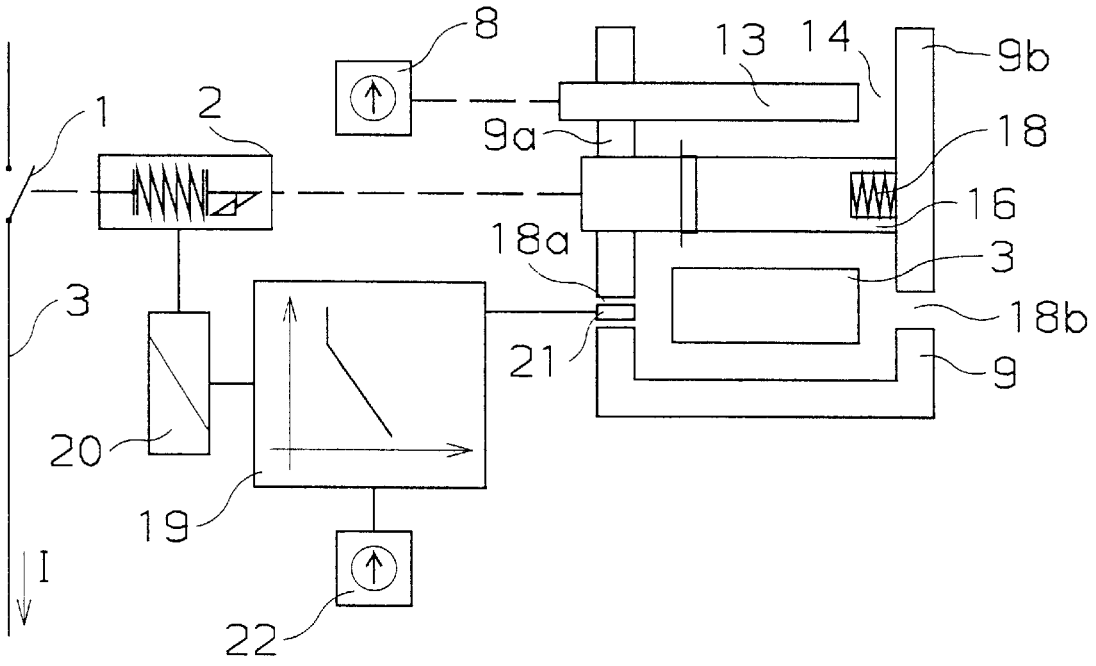
FIG. 5 represents the diagram of a circuit breaker comprising an electromagnetic trip device according to a third embodiment of the invention.

A trip device comprising distributed air gaps is represented in the diagram of a circuit breaker in FIG. 5. In this diagram, the magnetic circuit 9 comprises two additional air gaps 18*a* and 18*b* to increase the circuit breaker rating. The movable element is represented, in its second closed position, attracted towards the fixed part 9*b* to actuate the opening mechanism 2.

Since the air gaps 18*a* and 18*b* decrease the magnetic flux, a higher current I is required to reach the flux level enabling tripping. The current threshold IS is consequently higher without the element and the shunt changing dimensions or air gaps.

The circuit breaker of FIG. 5 comprises an electromagnetic trip device 5 according to an embodiment of the invention, a processing unit 19, a relay 20 and a sensor 21 connected to the processing unit. The processing unit, used in conjunction with the electromagnetic trip device, enables other types of protection of the power system to be achieved, for example thermal or earth fault protections.

The sensor 21 supplies to the processing unit a signal representative of the current flowing in the conductor 3. This sensor located in an air gap 18*a* of the magnetic circuit is preferably a sensor sensitive to a magnetic quantity, for example a Hall effect or magnoetoresistive effect.

The processing unit 19 receives signals from the sensor 21 and supplies a tripping order to the relay 20 if thresholds are exceeded for predetermined durations. The thresholds of the processing unit are supplied by second adjustment means 22. The relay 20 actuates the contact opening mechanism 2 when it receives a tripping order coming from the processing unit 19.

In other circuit breakers according to the invention, electromagnetic trip devices comprising shunt-based adjustment devices can be used in conjunction with thermal trip devices.

The shunt-based adjustment devices for trip devices according to the invention can have widely varying forms, for example they can partially coat the movable element in the form of a sliding plunger.

In the figures, the conductor 3 is represented by a bar. However, it is possible for low current trip devices to have a conductor 3 forming several turns wound on the magnetic circuit or on the whole of the adjustment device and movable element.

In the embodiments described above, the movable element is a sliding plunger or an articulated blade. But it is also possible to use other forms of movable elements.

We claim:

1. An adjustable electromagnetic trip device comprising:

a fixed magnetic circuit designed substantially to encircle an electrical conductor;

a movable magnetic element adjacent to said magnetic circuit and maintaining a predefined maximum air gap distance with respect to the magnetic circuit;

an adjustment mechanism for varying the threshold at which a current in the conductor will trip the movable element from a first open operating position to a second closed tripped position, said mechanism also comprising a magnetic shunt defining an air gap between first and second parts of the magnetic circuit, so that adjustment of the current threshold causes the air gap defined by said magnetic shunt to vary; and a sensor for detecting magnetic quantity located in an air gap of the magnetic circuit.

2. The trip device according to claim 1 wherein the sensor detecting magnetic quantity is a Hall effect sensor.

3. The trip device according to claim 1 wherein the sensor detecting magnetic quantity is a magnetoresistive effect sensor.

4. The trip device according to claim 1 wherein the movable magnetic element is a plunger slidable with respect to a first fixed part of the magnetic circuit, said plunger defining an air gap with respect to a second fixed part of the magnetic circuit when it is in a first open position and substantially no air gap with respect to said second fixed part when it is in a second closed position.

5. The trip device according to claim 1 wherein the magnetic shunt is located between said first and second parts as a branch-off, for diverting magnetic flux from the movable element.

6. The trip device according to claim 1 wherein the magnetic circuit further comprises a plurality of air gaps, each air gap being positioned at a location within said magnetic circuit spaced from other air gaps.

7. A circuit breaker having the trip device according to claim 1, said circuit breaker comprising main contacts, an opening mechanism for the main contacts, and adjustment parts, and at least one trip device associated with at least one conductor which is a main conductor, the adjustment parts being connected to the opening mechanism.

8. The trip device according to claim 4 comprising a processing unit, a trip relay connected to the opening mechanism, at least one sensor connected to a processing unit supplying a value representative of a current in the main conductor and second adjustment means connected to the processing unit.

* * * * *

UNITED STATES PATENT AND TRADEMARK OFFICE

CERTIFICATE OF CORRECTION

PATENT NO. : 5,870,009

DATED : February 9, 1999

INVENTOR(S) : Marc SERPINET and Laurent PREVIEUX

It is certified that error appears in the above-indentified patent and that said Letters Patent is hereby corrected as shown below:

On the title page, item [75] Inventors: change "Le Floreal" to --Montchaboud-; and Item [73] Assignee: change "Schneider Electronic SA" to --Schneider Electric SA--.

Signed and Sealed this

First Day of June, 1999

*Attest:*

*Attesting Officer*

Q. TODD DICKINSON

*Acting Commissioner of Patents and Trademarks*